US010227157B2

(12) United States Patent
Kuruvilla et al.

(10) Patent No.: US 10,227,157 B2
(45) Date of Patent: Mar. 12, 2019

(54) EGG CARTON WITH DIAGONAL LID PANEL

(71) Applicant: Tekni-Plex, Inc., Wayne, PA (US)

(72) Inventors: Babu Kuruvilla, Griffin, GA (US); Roger Lichtle, Decatur, IN (US); Mark A. Bergeron, Monroe, GA (US); Robert Andrew Eberle, Lindenhurst, IL (US); Oleg Berger, Hawthorn Woods, IL (US)

(73) Assignee: TEKNI-PLEX, INC., Wayne, PA (US)

( * ) Notice: Subject to any disclaimer, the term of this patent is extended or adjusted under 35 U.S.C. 154(b) by 158 days.

(21) Appl. No.: 15/366,490

(22) Filed: Dec. 1, 2016

(65) Prior Publication Data

US 2018/0155079 A1 Jun. 7, 2018

(51) Int. Cl.

| | |
|---|---|
| ***B65D 21/032*** | (2006.01) |
| ***B65D 21/02*** | (2006.01) |
| ***B65D 43/16*** | (2006.01) |
| ***B65D 85/32*** | (2006.01) |
| ***B65D 51/24*** | (2006.01) |

(52) U.S. Cl.

CPC ..... *B65D 21/0223* (2013.01); *B65D 21/0217* (2013.01); *B65D 43/169* (2013.01); *B65D 51/245* (2013.01); *B65D 85/32* (2013.01); *B65D 85/324* (2013.01)

(58) Field of Classification Search

CPC ..... B65D 21/0233; B65D 85/324; B65D 43/169; B65D 51/245

USPC ..... 220/508; 206/512

See application file for complete search history.

(56) References Cited

U.S. PATENT DOCUMENTS

| | | | | |
|---|---|---|---|---|
| 2,668,652 | A * | 2/1954 | Russell | B65D 85/324 206/521.1 |
| D305,405 | S | 1/1990 | Wilkinson | |
| 5,102,034 | A * | 4/1992 | Amabili | B65D 85/324 206/521.1 |
| D405,365 | S | 2/1999 | Herbruck | |
| D418,405 | S | 1/2000 | Herbruck | |
| 7,686,181 | B2 * | 3/2010 | St-Onge | B65D 85/32 220/324 |

(Continued)

*Primary Examiner* — Stephen Castellano

(74) *Attorney, Agent, or Firm* — Polsinelli PC

(57) ABSTRACT

A plastic egg carton having features that enable aligning and stacking of multiple cartons for transport, and providing easy-to-view print and labeling areas in multiple directions. In one embodiment, the egg carton has a unique lid including a flat diagonal stacking panel (also referred to as a diagonal lid panel) that extends between two opposing corners of the rectangular shaped carton. The top wall of the diagonal lid panel can receive labeling or printing. The diagonal lid panel also includes a sidewall extending downwardly from the top wall toward a bottom perimeter edge of the lid, the sidewall having at each of the two opposing corners at least one flat side panel that can also receive printing or labeling. In one embodiment, each of the opposing corners includes a rounded corner portion and two flat side panels disposed on either side of the rounded corner, thus providing a total of four side viewing areas (each in a different direction) for labeling or printing, enabling the consumer to view information such as egg size, date, nutritional information, retail information, or UPC labels.

32 Claims, 7 Drawing Sheets

(56) References Cited

U.S. PATENT DOCUMENTS

| | | | | |
|---|---|---|---|---|
| 8,844,721 | B2 * | 9/2014 | Archambault | B65D 85/32 206/521.1 |
| D739,767 | S | 9/2015 | Schleining | |
| 9,169,058 | B1 * | 10/2015 | Ramirez | B65D 85/324 |
| 2013/0020224 | A1 | 1/2013 | Ramirez et al. | |

* cited by examiner

EGG CARTON WITH DIAGONAL LID PANEL

FIELD OF THE INVENTION

The present invention relates to plastic egg cartons and more particularly to an egg carton having features that enable aligning and stacking of multiple cartons for transport, and providing easy-to-view print and labeling areas in multiple directions.

BACKGROUND OF THE INVENTION

Many factors are taken into consideration in the design of egg cartons. Egg protection, stackability, transportability, aesthetic appearance, print surface area, strength, weight, nestability/denestability, adaptability to accommodate various size eggs, and consistent manufacturing are factors which may be considered to varying degrees in the design of an egg carton.

Egg cartons are formed and trimmed from a single sheet of plastic material to integrally define a lid and a tray connected by a hinged area. The egg cartons are transported, typically by conveyer belt, to a printing machine and imprinted with an egg distributor's trade style, date, government mandated nutritional information, and retail information, such as UPC labels. The egg cartons are then nested one within another and packaged in bags or pallets for shipping to egg distributors. The distributor then fills the cartons with eggs at a filling station and transports the filled cartons to another location. The process of transport of filled egg cartons requires that cartons first be stacked in a stable arrangement such that when physically moved on a pallet the multitude of stacked, filled cartons are transportable without risk of falling off the pallet, falling out of the stacked arrangement, and/or otherwise moving or collapsing so as to cause damage to the eggs.

SUMMARY OF THE INVENTION

The present invention provides a plastic egg carton and a method for aligning and stacking filled egg cartons, one filled carton on top of another, for stable transport. The cartons can, if desired, be sized for packing in existing standard master corrugated containers (e.g., full or half size) and can accommodate variable sized eggs, such as variable sized jumbo eggs, as well as extra-large, large or medium sized eggs.

In one embodiment, the egg carton has a unique lid including a flat diagonal stacking panel (also referred to as a diagonal lid panel) that extends between two opposing corners of the rectangular shaped carton. The top wall of the diagonal lid panel can receive labeling or printing. The diagonal lid panel also includes a sidewall extending downwardly from the top wall toward a bottom perimeter edge of the lid, the sidewall having at each of the two opposing corners at least one flat side panel that can also receive printing or labeling. In one embodiment, each of the opposing corners includes a rounded corner portion and two flat side panels disposed on either side of the rounded corner, thus providing a total of four side viewing areas (each in a different direction) for labeling or printing, enabling the consumer to view information such as egg size, date, nutritional information, retail information, or UPC labels. The base of the egg carton includes, disposed under the diagonal lid panel when the carton is in the closed position, a plurality of cell posts that support the top wall of the diagonal lid panel to provide compressive strength when multiple cartons are stacked vertically one atop another.

The lid further includes, on either side of the diagonal lid panel, lid cells that mate with corresponding base cells of the carton base to form cell pockets, each holding an individual egg. The lid and base cells include mating cell posts between the cells that engage when the carton is in the fully closed position, again supporting the carton structurally when multiple cartons are stacked one on top of another.

In accordance with another feature of the invention, an anti-sliding rim is provided at each of the two opposing corners of the diagonal lid panel. This anti-sliding rim engages one or more base cells of a carton stacked on the flat top wall of the diagonal lid panel, to prevent transverse movement of the cartons in the stack.

In accordance with another feature of the invention, the lid includes at each of the other two opposing corners a corner cell having an anti-sliding rim, which similarly engages a corner base cell of a carton stacked on top of the first carton. Together the four anti-sliding rims (of the panel and corner lid cells) stabilize the stacked cartons against transverse movement (transverse to the height direction of the closed carton).

These and other features of the invention will be apparent from the detailed description.

In one embodiment, an egg carton comprising:

a plastic bi-fold egg carton having a rectangular shaped base and a rectangular shaped lid mating at perimeter edges and joined along one common perimeter edge by a hinge connection for pivoting the base and lid between open and closed positions;

the base having a matrix of base cells, each base cell being shaped to hold an individual egg;

the lid having:

- a first lid portion, extending between two opposing corners of the rectangular shaped lid, comprising a flat diagonal stacking panel on a top of the lid and a flat corner sidewall panel adjacent each of the two opposing corners;
- second lid portions, one adjacent each of the other two opposing corners of the rectangular shaped lid, each having lid cells;

the matrix of base cells including:

- first base cells disposed beneath the flat diagonal stacking panel of the first lid portion; and
- second base cells disposed beneath the lid cells of the second lid portion to form a complementary matrix of cell pockets for holding individual eggs when the lid is in the closed position over the base.

In one embodiment the base includes first cell posts, disposed between the first base cells, that support the flat diagonal stacking panel when a second closed egg carton is stacked vertically on the top of a first closed egg carton.

In one embodiment the base and lid include second cell posts, disposed between the second base cells and lid cells, with support surfaces that engage when the lid is in the closed position over the base.

In one embodiment the flat diagonal stacking panel has an anti-sliding rim, at each of the two opposing corners, for engaging the base cells of a second closed egg carton, stacked vertically on the top of a first closed egg carton.

In one embodiment the lid cell, at each of the other two opposing corners, has an anti-sliding rim for engaging the base cell of a second closed egg carton stacked vertically on the top of a first closed egg carton.

In one embodiment the base cells and lid cells have expandable portions adapted to accommodate eggs of different sizes.

In one embodiment the expandable portions include a movable bottom wall.

In one embodiment the base cells and lid cells each have a bottom standing perimeter and a recessed central portion, and the movable bottom wall is disposed in the recessed central portion.

In one embodiment the first lid portion has a sidewall that includes at each of the two opposing corners, a rounded corner portion disposed between two flat sidewall panels.

In one embodiment each flat sidewall panel is inclined toward an exterior of the closed carton in a direction of the lid perimeter.

In one embodiment at each of the mating perimeter edges of the base and lid, not joined by the hinge connection, the base and lid have mating support surfaces disposed parallel to the top wall of the lid in the closed carton.

In one embodiment the lid cells and base cells each have a sidewall and a bottom wall, the sidewall having a plurality of sidewall ribs extending away from the bottom wall.

In one embodiment the bottom wall has base ribs extending from the sidewall ribs.

In one embodiment the bottom wall of each base cell has a bottom standing perimeter and a central recessed portion, and the base ribs extend into the bottom standing perimeter.

In one embodiment the base wall of each lid cell has a flat bottom standing perimeter without ribs, and a central recessed portion.

In one embodiment the central recessed portion of each base cell and lid cell has a movable wall portion, that together with the sidewall ribs, allows the cell to expand to accommodate different sized eggs.

In one embodiment the different sized eggs are in a size range from medium to jumbo.

In one embodiment the different sized eggs are in a weight range of from 1.75 to 2.75 ounces per egg.

In one embodiment the egg cartons being arranged in a vertical stack wherein at least one closed egg carton has another closed egg carton resting on the top wall of the one closed egg carton.

In one embodiment the egg cartons being arranged in a vertical stack wherein at least one closed egg carton has another closed egg carton resting on the top wall of the one closed egg carton, and the anti-sliding rims deter horizontal sliding movement of the egg cartons in the vertical stack.

In one embodiment the anti-sliding rims of the corner lid cells extend about a rim circumference in a range of 70 to 90 degrees.

In one embodiment the anti-sliding rims of the corner lid cells extend about a rim circumference in a range of 70 to 90 degrees.

In one embodiment the anti-sliding rims of the flat diagonal panel extend about a rim circumference in a range of 70 to 90 degrees.

In one embodiment the egg carton comprises a 3×6, 4×6, 5×6, or 6×6 matrix of base cells.

In one embodiment the egg carton comprises a rectangular 3×6 matrix of base cells.

In one embodiment the plastic comprises a thermoplastic which is foamed or unfoamed.

In one embodiment the plastic comprises one or more of polystyrene, polyester, polyolefin, and poly(lactic acid), including homopolymers, copolymers, mixtures and blends thereof, and including virgin and reclaim materials.

In one embodiment the plastic comprises one or more of polyethylene terephthalate and polystyrene.

In one embodiment the plastic egg carton comprises a clear plastic solid sheet.

BRIEF DESCRIPTION OF THE DRAWINGS

FIG. 11 is an exploded partial sectional view of the lower end of an egg in a base cell, illustrating various positions of a movable bottom wall for accommodating different sized eggs.

DETAILED DESCRIPTION OF THE INVENTION

Figure 1:
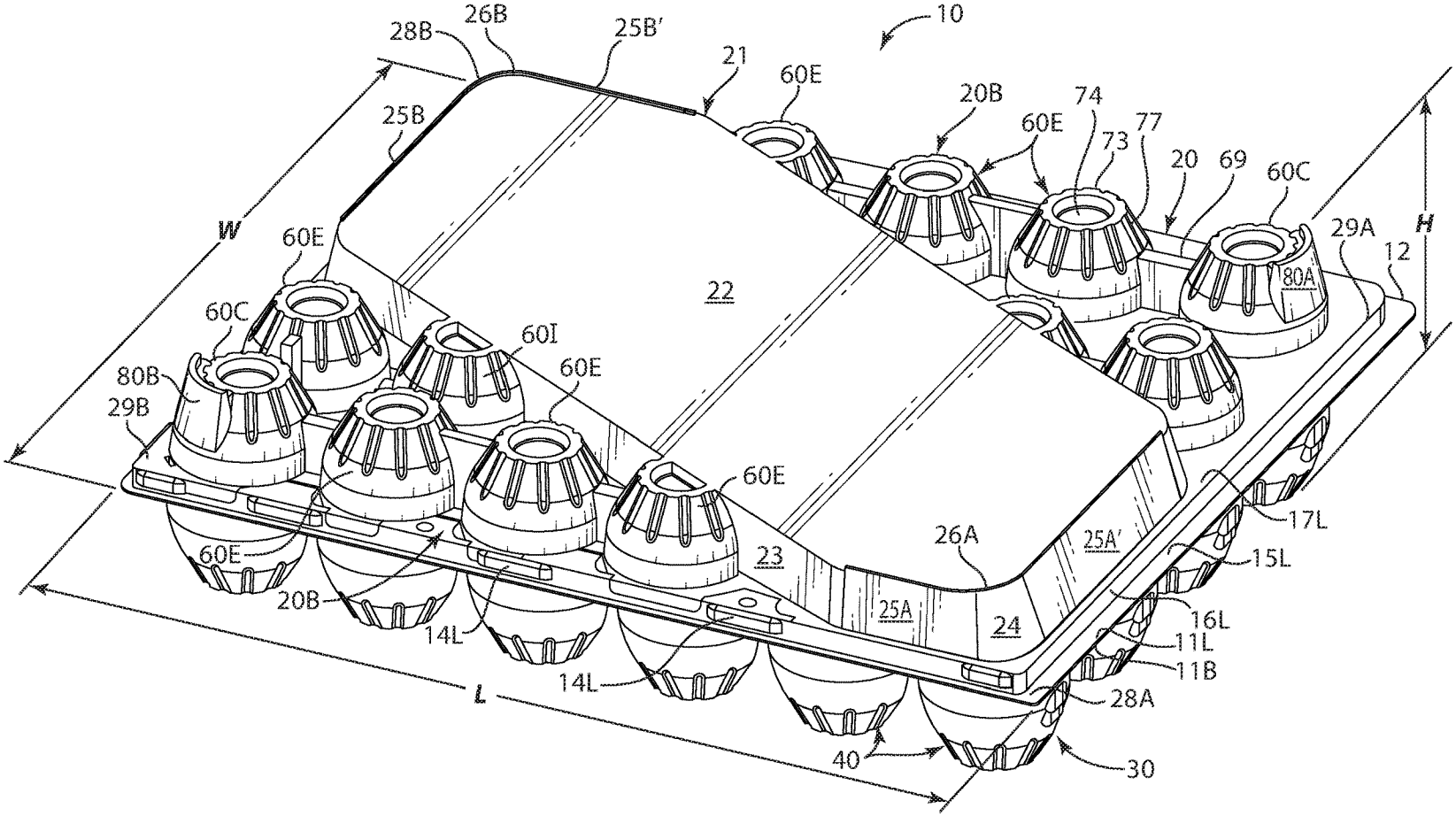
FIG. 1 is a top right perspective view of a 4×6 matrix egg carton according to one embodiment of the invention, showing the carton in a closed position.

FIG. 1 shows in perspective view an egg carton 10 according to one embodiment of the invention. The carton 10, having general overall dimensions of length L, width W, and height H in a closed position, is comprised of a lid 20 connected via a hinge 12 to a base 30, the base comprising a plurality of egg receiving cells 40 arranged in a matrix. The carton has a rectangular shaped base and rectangular shaped lid mating at perimeter edges 11L and 11B (for the lid and base respectively), and joined along one common edge by the hinge connection 12 for pivoting the base and lid between open and closed positions. This type of egg carton is also referred to as a "bi-fold" egg carton as the lid is folded over the base via the hinge to the closed position.

The carton 10 is typically integrally molded from a sheet of plastic material which is formed into an end product having the components described herein via conventional molding processes, e.g., pressing a plastic sheet between male and female dies to form shaped lid and base portions and then removing (trimming) any remaining portions of the sheet to form an integral carton. The plastic can be foam or unfoamed (e.g., a solid plastic sheet), such as a clear solid plastic sheet of polyester (e.g., virgin or recycled polyethylene terephthalate (PET)), or a blend including polyester and/or polystyrene. The formation and structure of components such as the hinge 12, locking nubs and apertures of the base and lid 14B and 14L respectively, base cells 40 and the like can be formed by the conventional molding processes as described above.

Figure 2:
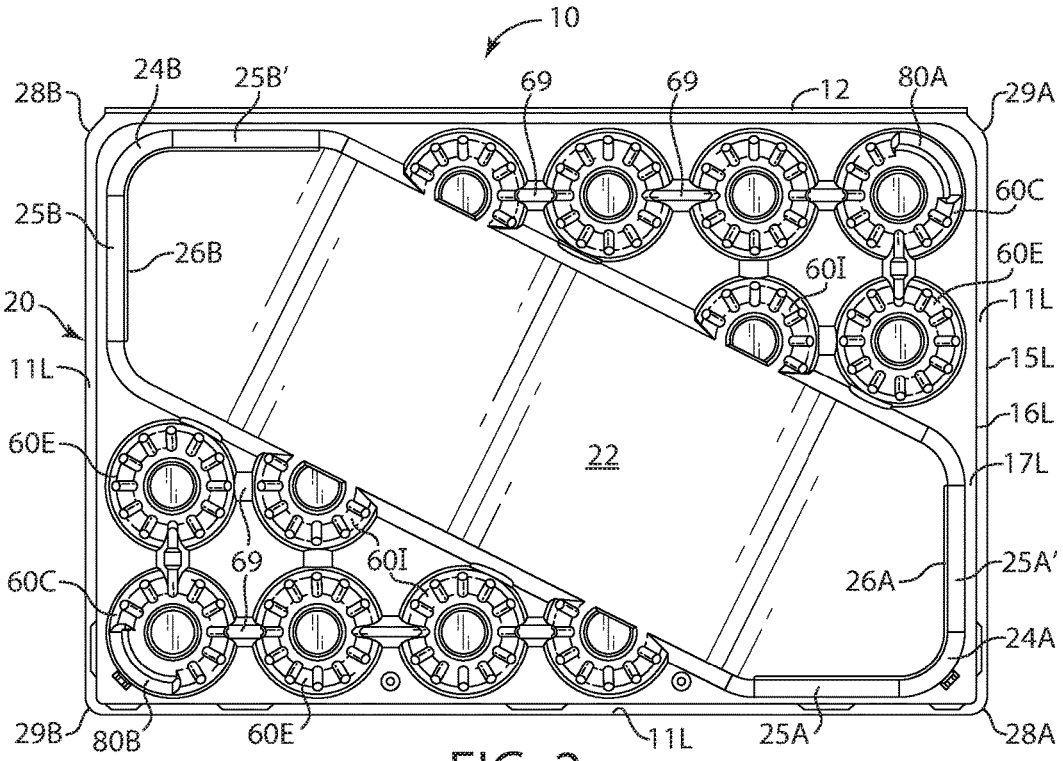
FIG. 2 is a top plan view of the FIG. 1 carton.
Figure 3:
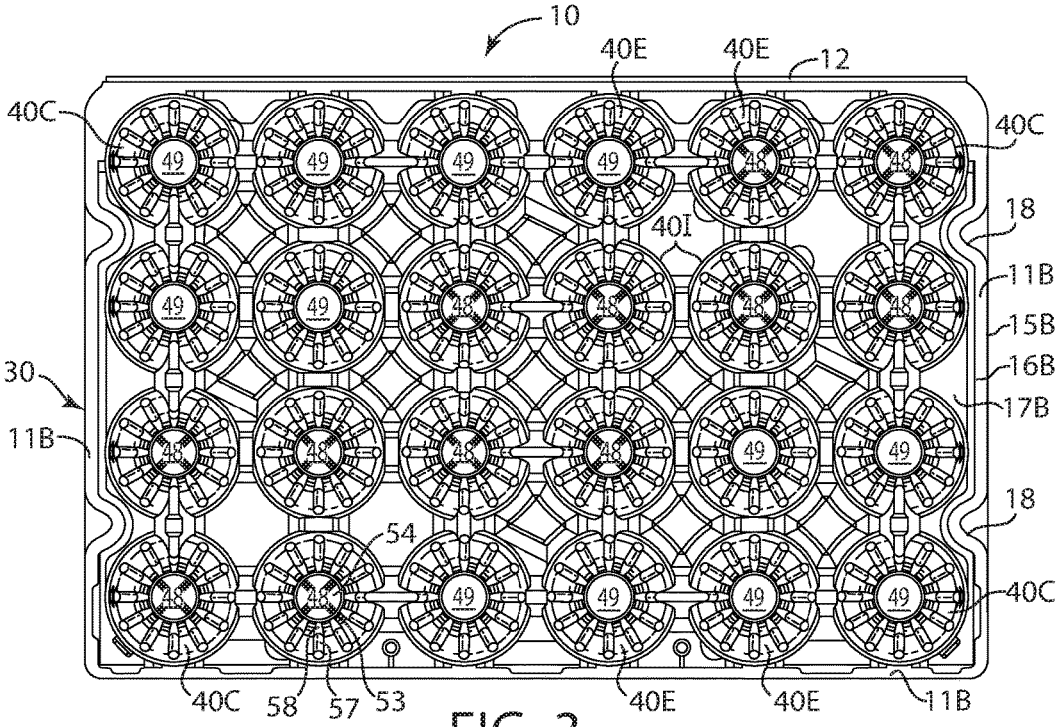
FIG. 3 is a bottom plan view of the FIG. 1 carton.

As shown in FIGS. 1-3, the lid 20 includes a number of features according to the present invention that facilitate aligning and stacking of multiple cartons for transport, and also provides multiple areas visible to the consumer from both top and side views for printing or labeling. In particular, the lid 20 includes a first lid portion 20A, extending between two opposing corners 28A and 28B of the rectangular shaped lid, and second lid portions 20B on either side of the first lid portion, adjacent each of the other two opposing corners 29A and 29B of the lid. The first lid portion comprises a flat diagonal stacking panel 21, consisting of a flat diagonal top wall 22 of the lid and depending downwardly therefrom toward a bottom perimeter edge 15L of the lid, a sidewall 23 and one or more sidewall panels 25A and 25B adjacent each of the two opposing corners 28A and 28B, respectively. The matrix of base cells 40 include first base cells 48 (marked with an "X" in FIG. 3) disposed beneath the first diagonal lid portion 21, and extended base cell posts between the first base cells that support the top wall 22 of the panel 21 in the closed position. The second lid portions 20B, adjacent each of the other two opposing corners 29A and 29B of the rectangular shaped lid, include lid cells 60. The base includes second base cells 49 (the remaining cells not marked with an "X" in FIG. 3) disposed beneath the lid cells of the second lid portion 20B to form a complimentary matrix of cell pockets for holding individual eggs when the lid is in the closed position over the base (see e.g. egg 2 in dashed lines in FIG. 4). The mating lid 60 and second base cells 49 in the second lid portions further include mating cell posts 46 and 66 (see FIG. 8) between the lid and second base cells that structurally support the closed carton against compressive forces in the height direction.

More specifically, the rectangular shaped lid 20 has a flat diagonal stacking (FDS) panel 21 including an FDS top wall 22 and FDS peripheral sidewall 23. The FDS panel extends between two opposing corners 28A and 28B of the lid. At each corner 28A and 28B, the FDS sidewall 23 includes a rounded corner portion 24A, 24B disposed between two flat sidewall panels 25A, 25A' and 25B, 25B' respectively, the four flat sidewall panels forming printing or labeling surfaces viewable from the four sides of the carton (from each of the length and width sides). The height of the peripheral sidewall 23, and dimensions of the rounded corner 24 and flat panels 25 can be selected by the package designer to accommodate different labeling sizes, and different sized eggs, as described further below.

Figure 12:
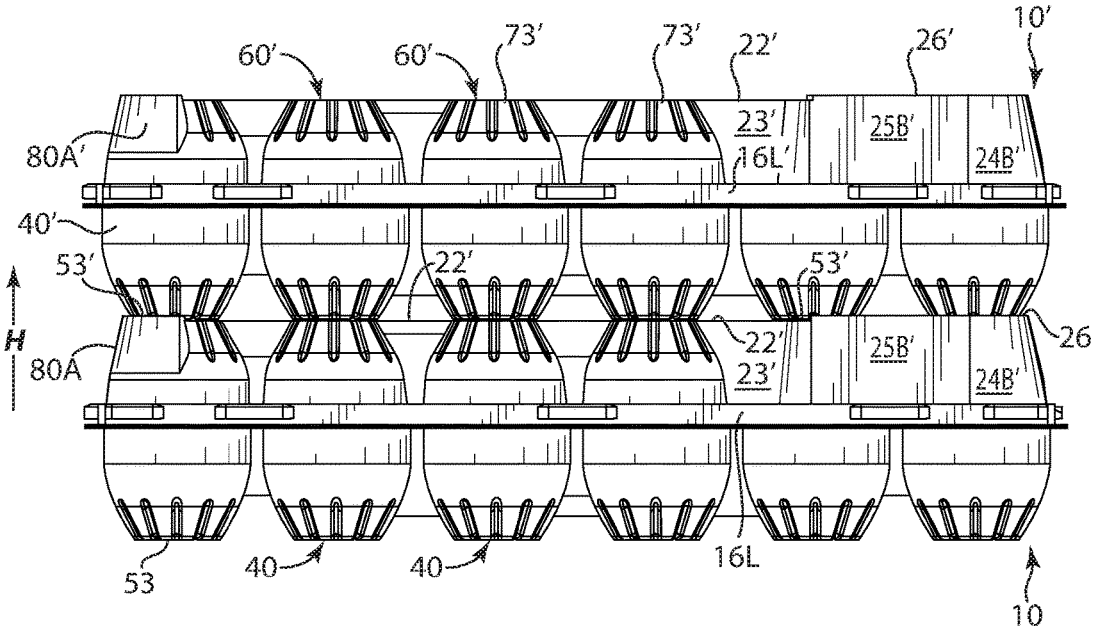
FIG. 12 is a front view of two closed cartons of FIG. 1 stacked vertically one atop another.
Figure 13:
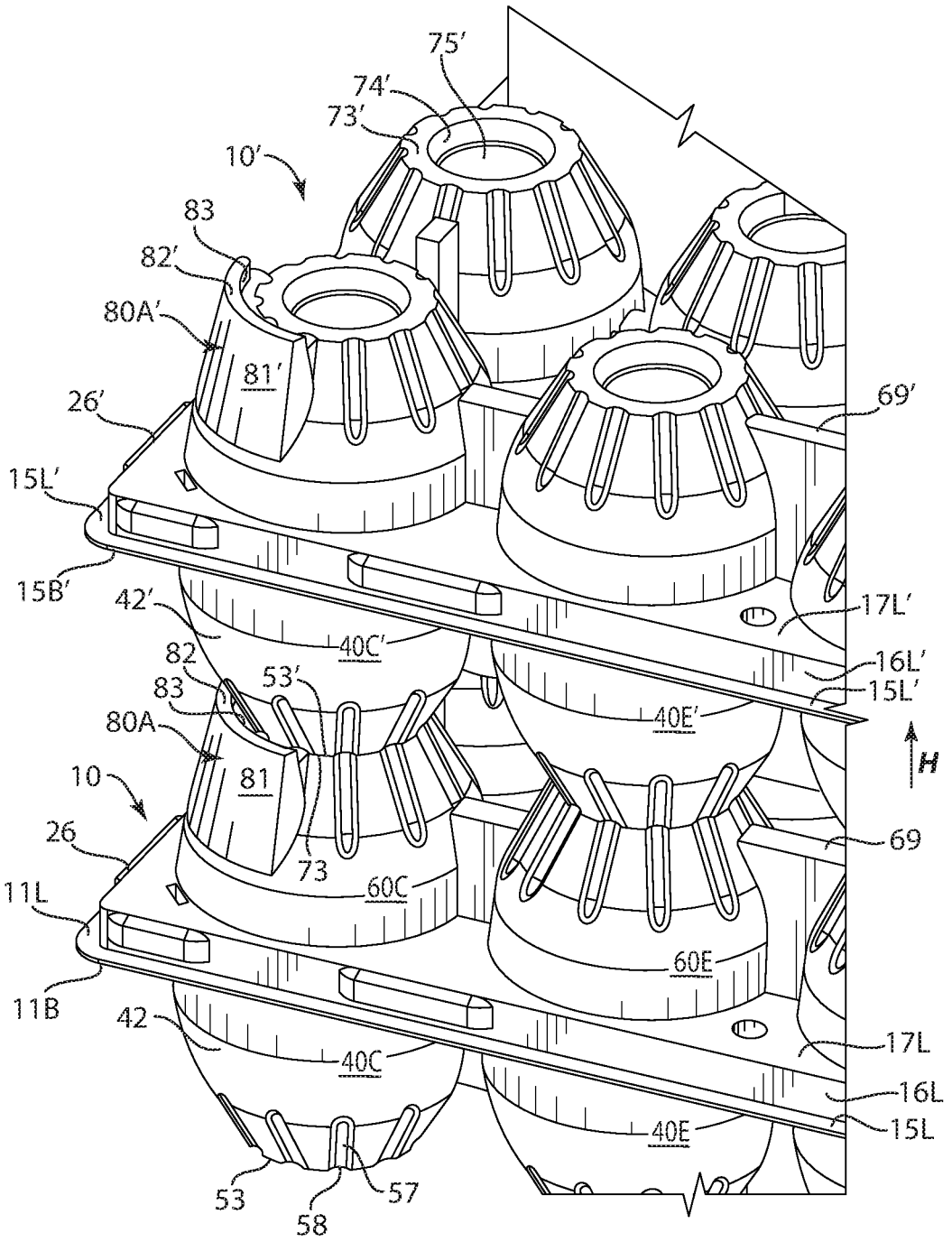
FIG. 13 is an exploded partial perspective view of one corner area of the two stacked cartons of FIG. 12.

AS a further feature of the invention, the top wall 22 has a pair of anti-sliding rims 26A and 26B, one at each of the opposing corners 28A and 28B respectively. These anti-sliding rims are designed to prevent or deter movement in a transverse (horizontal) plane of a second carton stacked on top of the top wall 22, as shown in FIGS. 12-13 and described further below.

As shown in FIG. 1, the lid cells include exterior lid cells 60E that border the perimeter edges 11L and 12 of the carton lid, and one or more interior lid cells 601 that are surrounded by exterior lid cells 60E and the diagonal panel 21. The two lid cells disposed at the opposing corners 29A and 29B of the lid, are referred to as corner lid cells 60C and are also exterior lid cells 60E.

As a further feature of the invention, the two corner lid cells 60C, 60C disposed at the corners 29A and 29B respectively each include an anti-sliding rim 80A and 80B. The anti-sliding corner rims 80A and 80B engage (or are in close proximity to) the lower sidewall of the a respective corner base cell 40C', 40C' of a second carton 10' stacked on top of the first carton 10, again to prevent movement in a transverse (horizontal) plane between the vertically stacked cartons. FIGS. 12-13 show two such vertically stacked cartons 10 and 10', as well as the engagement (or close proximity) between one corner anti-sliding rim 80A and corner base cell 60C of the second carton 10' stacked on top of the first carton 10, as well as the engagement (or close proximity) of the anti-sliding rim 26 with multiple exterior base cells 40E of the second container 10' stacked on top of the first container 10.

The anti-sliding rims 26 and 80, and the labeling and printing areas 25 of the flat diagonal lid panel 21 will be further described with respect to the various views shown in the Figures. The lid cells 60, disposed on each opposing side of the diagonal panel 21, are substantially similar to the base cells 40, the latter being described in detail below.

Figure 4:
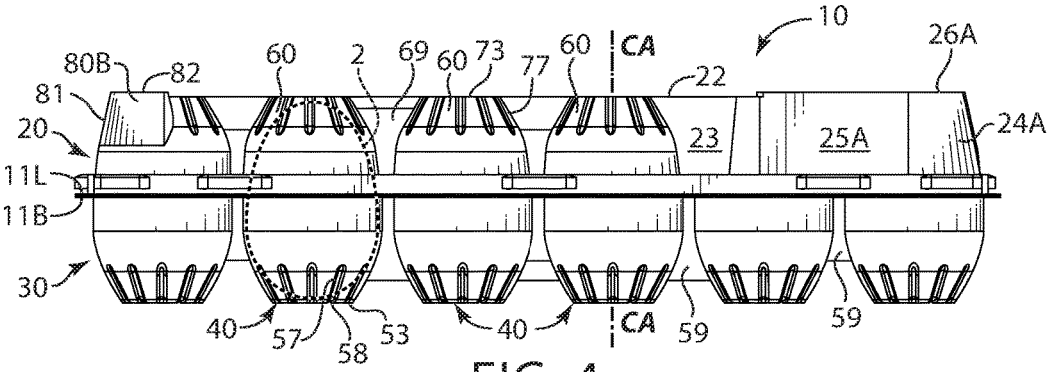
FIG. 4 is a front view of the FIG. 1 carton.
Figure 5:
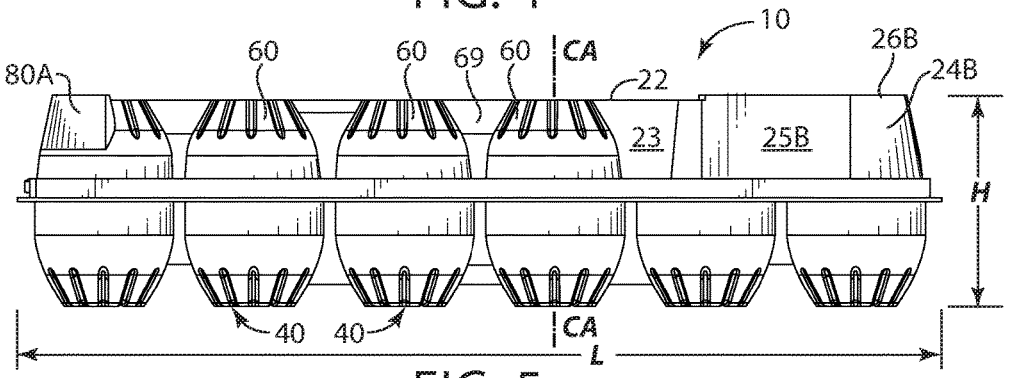
FIG. 5 is a back view of the FIG. 1 carton.
Figure 6:
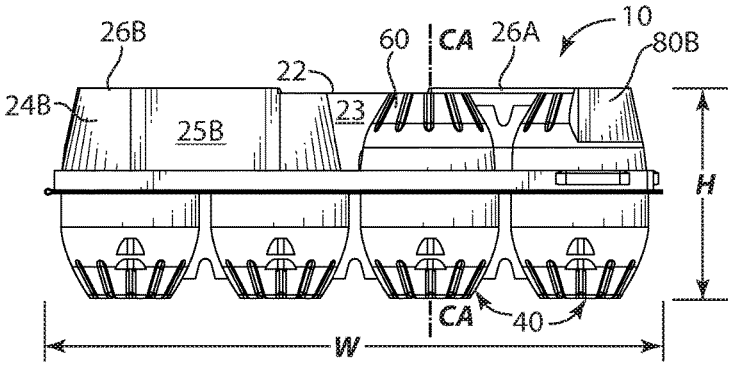
FIG. 6 is a right side view of the FIG. 1 carton.
Figure 7:
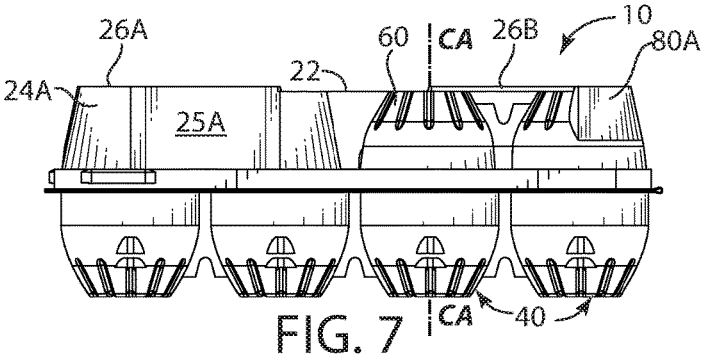
FIG. 7 is a left side view of the FIG. 1 carton.

FIGS. 2-3 are top and bottom plan views of the closed carton respectively. FIGS. 4-5 are side views from the front and rear, taken along the elongated perimeter of the closed carton (in the L direction). FIGS. 6 and 7 are right and left end views of the closed carton, taken along the width W direction.

In the present embodiment, the base includes a rectangular 4×6 matrix of base cells 40 (see FIGS. 3 and 8), each base cell having a central vertical cell axis CA in the height H direction of the closed carton with six base cells aligned along a common longitudinal axis parallel to the L direction, and four base cells aligned along a common axis in the width W direction. The lid cells 60 in the second portion 20B of the lid, adjacent either side of the flat diagonal panel 21, are similarly arranged so as to be aligned along the same central cell axis CA of a respective mating base cell that lies below the lid cell, together forming a cell pocket for holding an individual egg (see egg 2 shown in dashed lines in FIG. 4, second pocket from left end, formed by mating lid cell 60 and base cell 40 aligned vertically along CA). As shown in FIG. 2, there are a lesser number of lid cells (12 total) than base cells (24 total), as no lid cells are present in the area of the flat diagonal panel 21. Also, in this embodiment, at least some of the lid cells that border the flat diagonal panel 21 are partially cut off by the panel. However, the lid cells present on either side of the flat diagonal panel structurally strengthen the closed carton and hold individual eggs securely protected from both compressive forces in the H direction and transverse forces in the L and W directions.

Figure 8:
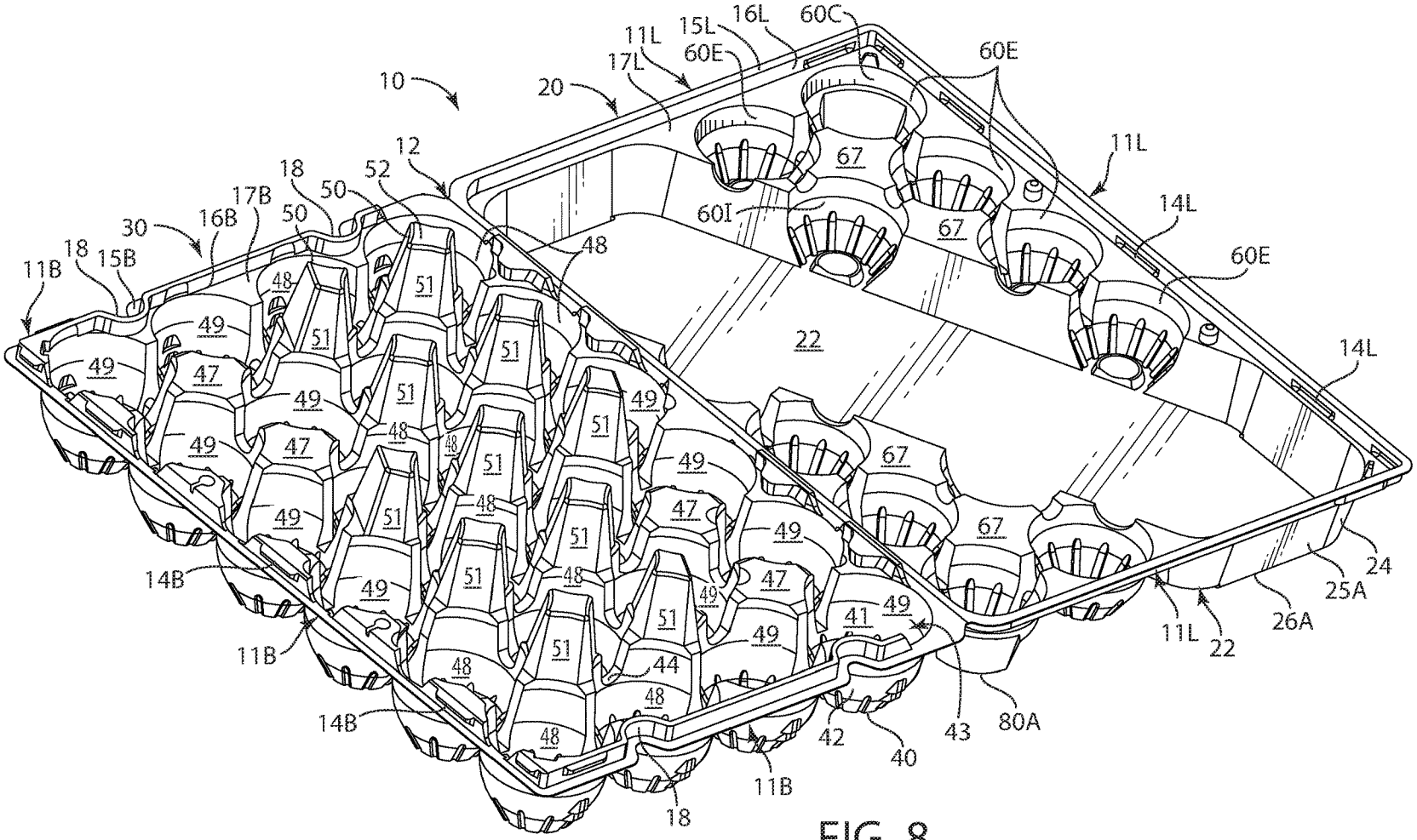
FIG. 8 is a top perspective view of the FIG. 1 carton in an open position.
Figure 9:
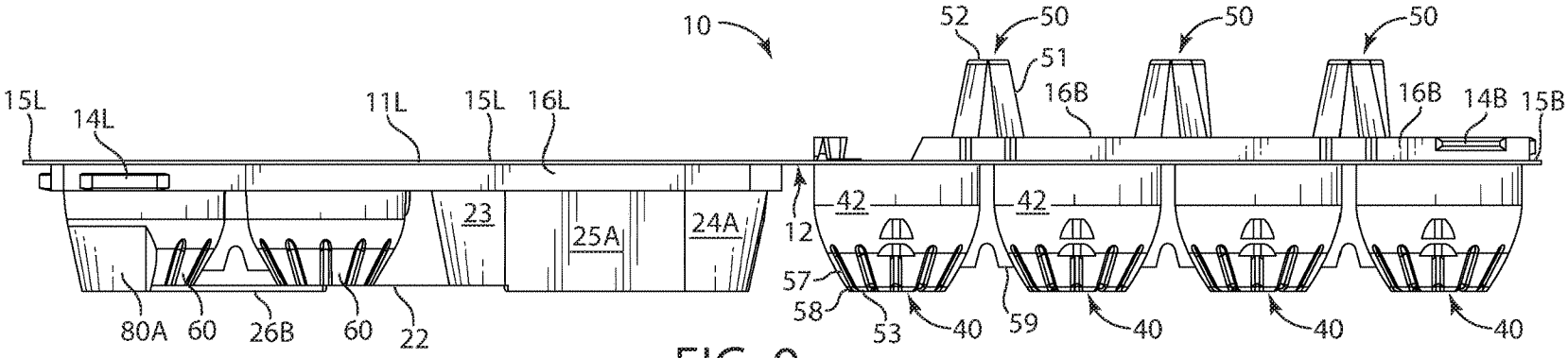
FIG. 9 is a right side view of the open carton of FIG. 8.
Figure 10:
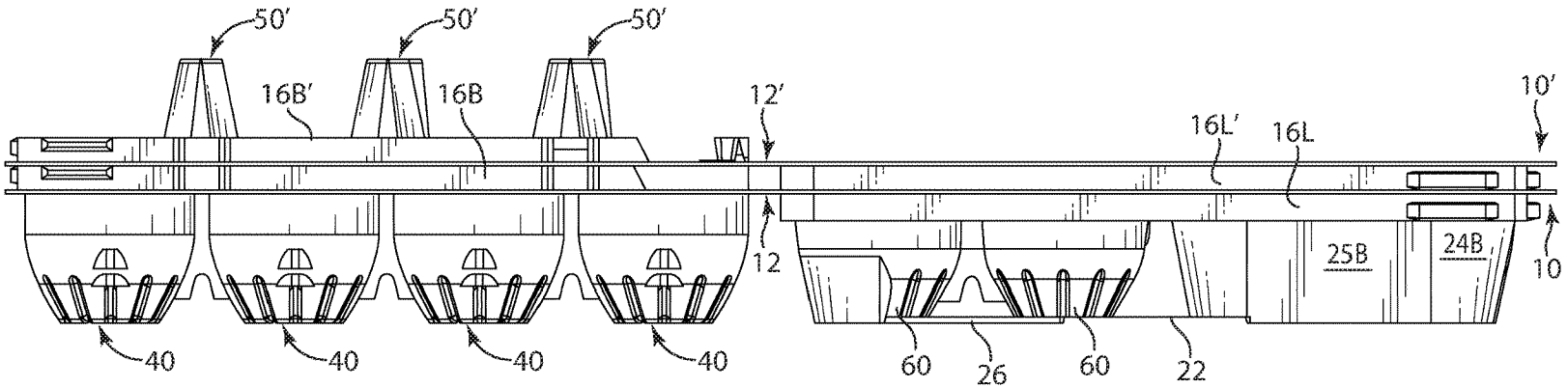
FIG. 10 is a left side view of two open stacked cartons of FIG. 8.
Figure 1:
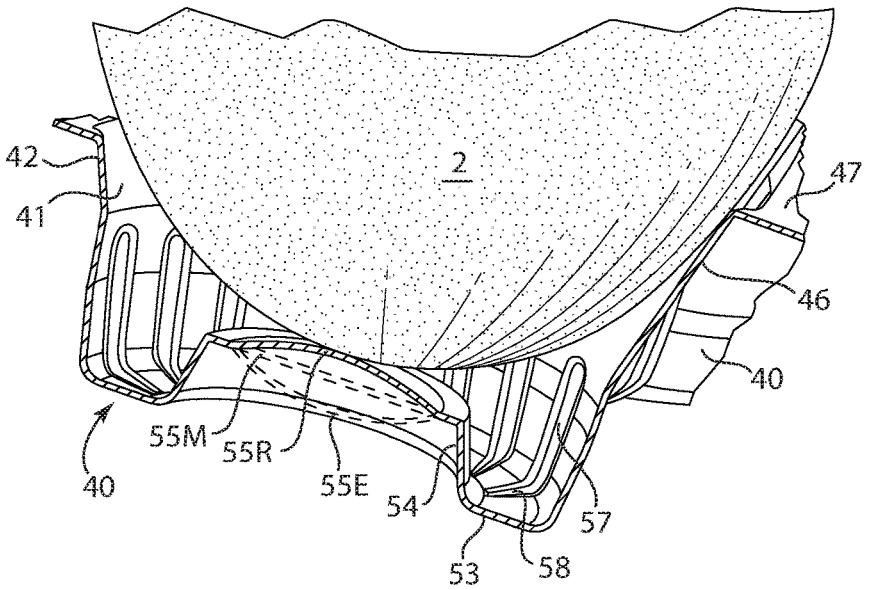

FIGS. 8-10 show the carton 10 in an open position, and more clearly illustrate the structural components of the base and lid cells, as well as cell posts 46, 50 and 66 (described further below) disposed between the rows and columns of the base and lid cells to strengthen the egg carton against compressive forces applied in the H direction.

As shown in FIG. 8, the base 30 of the carton 10 comprises a 4×6 matrix of egg receiving cells 40 each formed to receive and accommodate a single egg. Each of the base cells is formed with a sidewall 42 having an inner receiving surface 41 contoured to receive the ovoid shape of an egg (see FIGS. 4 and 11). The sidewall 42 extends upwardly (toward the closed carton lid) to define an open top end 43 and, where there is an adjoining cell 40, the two sidewalls 42 cooperatively define a cell junction 44 (see FIG. 8). The cell junction is flexible to respond to pressure applied by packaged eggs and provides protection therefor. Preferably, the carton comprises an even number of cells (for example 12, 18, 24, etc.) serially interconnected either widthwise of lengthwise of the carton. In FIGS. 1-13 the carton 10 comprises four rows of six cells, each row extending along the length L of the carton 10. Typical other rectangular cell matrix formats are 3×6, 5×6, and 6×6.

By way of example only, the 4×6 matrix carton shown in FIGS. 1-13 is designed to hold twenty four jumbo sized eggs, in a range of jumbo sized egg weights from 30-33 ounces per dozen, or 2.50 to 2.75 ounces per egg. The carton can also accommodate a variety of smaller sized eggs, such as medium, large, and extra large eggs. The ability to accommodate different sized eggs is due to the flexible nature of the cell sidewalls 42 which include a plurality of elongated sidewall ribs 57, aligned substantially parallel to the height direction and spaced apart uniformly around the circumference of the cell sidewall 42. In addition, each base and lid cell includes a movable base wall portion to accommodate different sized eggs. More specifically, as illustrated in FIG. 11, the cell sidewall 42 is joined at its lowermost surface to a bottom standing perimeter 53 in the shape of a ring; the bottom standing perimeter is the lowermost surface on which the carton base rests on a standing surface. The cell bottom further includes an inwardly recessed central portion 54 in which there is disposed a movable wall 55. In the disclosed embodiment, the movable wall is dome shaped, and is movable between a retracted (inward) position 55R, to an extended (outward) position 55E, moving through a mid-position 55M between 55R and 55E. The dome in retracted position 55R is concave upwardly, toward the interior of the cell 40. In extended position 55E, the dome is concave outwardly, away from the interior of the cell 40, but still within the recessed central portion 54.

Returning to FIG. 3, the matrix of base cells include a plurality of first base cells 48 (here the 12 based cells marked with an X in FIG. 3) that are disposed beneath the diagonal stacking panel 21 that extends between the two opposing corners 28A and 28B of the carton. As shown in FIG. 8, these first base cells 48 have an extended post cell 50 between adjacent first base cells, the extended post cell 50 having a sidewall 51 with an uppermost support surface 52 that engages the lower (interior) surface of the top wall 22 of the flat diagonal lid panel 21 when the lid is closed over the base.

The base matrix further includes a plurality of second base cells 49 (here the remaining 12 base cells not marked with an X in FIG. 3) that are disposed beneath the second lid portions 20B on each side of the lid panel 21 (adjacent each of opposing corners 29A and 29B) to form, with the 12 lid cells 60 (6 on either side of the lid panel 21), the complimentary matrix of cell pockets for holding individual eggs when the lid is in the closed position over the base (see FIG. 4). These second base cells 49 also have cell posts 46 between adjacent second base cells, but the cell posts 46 are shorter than the extended cell posts 50 that support the diagonal panel top wall 22. The shorter cell posts 46 have an upper support surface 47 that is configured to engage a complimentary support surface 67 of a mating lid cell post 66. In this way, the mating lid and base cell posts 66 and 46, and the mating extended base cell post 50 and flat diagonal top wall 22, structurally support the closed carton against compressive forces applied in the height H direction, protecting all of the eggs in the 4 by 6 matrix via the intermediate cell posts.

FIGS. 9-10 are end views of one or more open and empty (not filled with eggs) cartons 10, shown across the width W direction. FIG. 9 shows a single carton 10, while FIG. 10 shows two empty and open cartons 10 and 10' nestled one within the other, with top carton 10' stacked within bottom carton 10. The hollow cell posts 50 and 46 of the first carton 10 can respectively be stacked with a similar cell post 50' and 46' of the adjacent (above) second carton 10'.

FIG. 11 is an exploded partial view of a base cell 40 holding a lower end of an egg 2. The ovoid shape of the egg 2 is accommodated by the ovoid shaped inner surface 41 of sidewall 42 of base cell 40, while the plurality of vertically aligned sidewall ribs 57 enable radial expansion and contraction of the sidewall 42 to accommodate different sized eggs. The bottom of cell 40 includes a lowermost standing perimeter 53 on which the base rests, and an inwardly recessed central portion 54. The center of the recess is a dome shaped movable wall 55 movable between: concave upwardly retracted position 55R, a middle position 55M, and an extended downwardly concave position 55E (still within the recessed central portion 54). The movable wall of the base thus accommodates different sized eggs in the base cell 40. The sidewall ribs 57 extend down through the base standing perimeter 53 as base ribs 58, to further accommodate expansion and contraction of the radial and height dimensions of the base cell 40. The lid cell 60 is similar, having sidewall ribs 77, lid standing perimeter 73, recessed central base portion 74 and movable base wall 75, but does not include base ribs in the standing perimeter 73 so that it presents a flat standing surface 73 for engagement by the base cell standing perimeter 53 of a second closed carton resting on the closed lid of the bottom (first closed) carton.

FIG. 12 illustrates two closed cartons, a second carton 10' being stacked vertically above and aligned with a bottom carton 10. The bottom standing perimeter 53' of the base cell 40' of top carton 10' rests on the respective vertically aligned lid standing perimeter 73 of the lid cell 60 of the bottom carton 10. The mating base and lid cell posts 46 and 66, and mating extended base posts 50 and diagonal lid top wall 22, provide vertical (H direction) compressive strength to the stacked cartons. To prevent movement in the transverse plane (transverse to the height H direction), the anti-sliding rim 26 of diagonal stacking panel 21 of the lower carton 10, engages the lower sidewall portion of the base cells 40 of the top carton 10', which rest on the top wall 22 of the panel 21 of the lower carton 10. In this embodiment, three of the base cells 40' abut or are adjacent to the anti-sliding rim 26 to prevent excessive transverse movement of the aligned cartons. Similarly, at the opposite corner the anti-sliding rim 80A of the corner lid cell 60C engages the sidewall of the corner base cell 40C' of the top carton 10', again preventing excessive transverse movement of the top carton with respect to the bottom carton. In alternative embodiments, if desired, additional anti-sliding rims may be provided on other ones of the lid cells and/or the anti-sliding rim on panel 21 may be extended further about the perimeter of the top wall 22 of panel 21.

FIG. 13 is an exploded partial perspective view of one corner of the two stacked cartons of FIG. 12, showing the lower sidewall portion of base corner cell 40C' abutting or adjacent to an inner sidewall 83 of the anti-sliding rim 80A on lid corner cell 60C. FIG. 13 also illustrates the standing perimeter 73' of the lid cells 60 which do not include base ribs, so as to provide a flat planar standing surface for the bottom standing perimeter 53 of the aligned base cell 40 of the second carton 10' stacked above the first carton 10.

It is to be understood that the foregoing description is intended to illustrate various embodiments and features of the invention and does not limit the scope of the invention to the disclosed embodiments.

What is claimed is:

1. An egg carton comprising:

a plastic bi-fold egg carton having a rectangular shaped base and a rectangular shaped lid mating at rectangular shaped lid and base perimeter edges and joined along one common perimeter edge by a hinge connection for pivoting the base and lid between open and closed positions, in the closed position, the carton having a height H in a vertical direction, and a length L and a width W in a plane transverse to the height H direction;

the base having a matrix of base cells, each base cell being shaped to hold an individual egg, each base cell having a vertical cell axis CA in the height H direction;

the rectangular shaped lid perimeter edge having four corners, the rectangular shaped lid having a first lid portion and two second lid portions disposed within the lid perimeter edge;

the first lid portion comprising a flat diagonal stacking panel extending diagonally between a first two opposing corners of the four corners of the rectangular shaped lid perimeter edge, the flat diagonal stacking panel comprising:

(a) a flat diagonal top wall disposed in a plane transverse to the height H direction for vertical stacking of another closed egg carton on the flat diagonal top wall, and (b) a peripheral sidewall having two opposing corner portions, each corner portion disposed adjacent a different respective one of the first two opposing corners of the lid perimeter edge and including two flat sidewall panels configured to receive printing or labeling;

one of the two second lid portions being disposed respectively between the first lid portion and a different respective one of the other two opposing corners of the rectangular shaped lid perimeter edge, each second lid portion having a plurality of lid cells and each lid cell being respectively vertically aligned with the vertical cell axis CA of one of the base cells;

the matrix of base cells including:

(a) first base cells disposed beneath the flat diagonal stacking panel of the first lid portion; and (b) second base cells disposed beneath the lid cells of one of the second lid portions to form a complementary matrix of cell pockets for holding individual eggs when the lid is in the closed position over the base.

2. The egg carton of claim 1, wherein:

the base includes first cell posts, disposed between the first base cells, that support the flat diagonal top wall when a second closed egg carton is stacked vertically on the top of a first closed egg carton.

3. The egg carton of claim 1, wherein:

the base and lid include second cell posts, disposed between the second base cells and lid cells, with support surfaces that engage when the lid is in the closed position over the base.

4. The egg carton of claim 1, wherein:

the flat diagonal stacking panel has an anti-sliding rim, at each of the first two opposing corners, for engaging the base cells of a second closed egg carton, stacked vertically on the top of a first closed egg carton.

5. The egg carton of claim 4, wherein the anti-sliding rims of the flat diagonal panel extend about a circumference of the flat top wall.

6. The egg carton of claim 4, wherein:

wherein the anti-sliding rims of the flat diagonal panel extend about a circumference of the flat top wall; and the lid cell, at each of the other two opposing corners, has an anti-sliding rim for engaging the base cell of a second closed egg carton stacked vertically on the top of a first closed egg carton.

7. The egg carton of claim 6, wherein:

the base includes first cell posts, disposed between the first base cells, that support the flat diagonal top wall when a second closed egg carton is stacked vertically on the top of a first closed egg carton.

8. The egg carton of claim 7, wherein:

the base and lid include second cell posts, disposed between the second base cells and lid cells, with support surfaces that engage when the lid is in the closed position over the base.

9. The egg carton of claim 1, wherein:

the lid cell, at each of the other two opposing corners, has an anti-sliding rim for engaging the base cell of a second closed egg carton stacked vertically on the top of a first closed egg carton.

10. A plurality of egg cartons of claim 9, the egg cartons being arranged in a vertical stack wherein at least one closed egg carton has another closed egg carton resting on the top wall of the one closed egg carton, and the anti-sliding rims deter horizontal sliding movement of the egg cartons in the vertical stack.

11. The plurality of egg cartons of claim 10, wherein the anti-sliding rims of the corner lid cells extend about a cell circumference of the corner lid cell by an angle in a range of 70 to 90 degrees of the entire cell circumference.

12. The egg carton of claim 9, wherein the anti-sliding rims of the corner lid cells extend about a cell circumference of the corner lid cell by an angle in a range of 70 to 90 degrees of the entire cell circumference.

13. The egg carton of claim 1, wherein:

the base cells and lid cells have expandable portions adapted to accommodate eggs of different sizes.

14. The egg carton of claim 13, wherein:

the expandable portions include a movable bottom wall.

15. The egg carton of claim 14, wherein:

the base cells and lid cells each have a bottom standing perimeter and a recessed central portion, and the movable bottom wall is disposed in the recessed central portion.

16. The egg carton of claim 1, wherein:

the peripheral sidewall includes at each of the first two opposing corners, a rounded corner portion disposed between the two flat sidewall panels.

17. The egg carton of claim 16, wherein:

each flat sidewall panel is inclined toward an exterior of the closed carton in a direction of the lid perimeter edge.

18. The egg carton of claim 1, wherein:

at each of the mating perimeter edges of the base and lid, not joined by the hinge connection, the base and lid have mating support surfaces disposed parallel to the top wall of the lid in the closed carton.

19. The egg carton of claim 1, wherein:

the lid cells and base cells each have a sidewall and a bottom wall, the sidewall having a plurality of sidewall ribs extending away from the bottom wall.

20. The egg carton of claim 19, wherein:

the bottom wall has base ribs extending from the sidewall ribs.

21. The egg carton of claim 20, wherein:

the bottom wall of each base cell has a bottom standing perimeter and a central recessed portion, and the base ribs extend into the bottom standing perimeter.

22. The egg carton of claim 21, wherein:

the base wall of each lid cell has a flat bottom standing perimeter without ribs, and a central recessed portion.

23. The egg carton of claim 22, wherein:

the central recessed portion of each base cell and lid cell has a movable wall portion, that together with the sidewall ribs, allows the cell to expand to accommodate different sized eggs.

24. The egg carton of claim 23, wherein:

the different sized eggs are in a size range from medium to jumbo.

25. The egg carton of claim 23, wherein:

the different sized eggs are in a weight range of from 1.75 to 2.75 ounces per egg.

26. A plurality of egg cartons of claim 1, the egg cartons being arranged in a vertical stack wherein at least one closed egg carton has another closed egg carton resting on the top wall of the one closed egg carton.

27. The egg carton of claim 1, comprising a 3×6, 4×6, 5×6, or 6×6 matrix of base cells.

28. The egg carton of claim 27, comprising a rectangular 3×6 matrix of base cells.

29. The egg carton of claim 1, wherein the plastic comprises a thermoplastic which is foamed or unfoamed.

30. The egg carton of claim 29, wherein the plastic comprises one or more of polystyrene, polyester, polyolefin, and poly(lactic acid), including homopolymers, copolymers, mixtures and blends thereof, and including virgin and reclaim materials.

31. The egg carton of claim 29, wherein the plastic comprises one or more of polyethylene terephthalate and polystyrene.

32. The egg carton of claim 29, wherein the plastic egg carton comprises a clear plastic solid sheet.

* * * * *